US011318769B2

(12) United States Patent
Kitayama

(10) Patent No.: US 11,318,769 B2
(45) Date of Patent: May 3, 2022

(54) IMAGE FORMING APPARATUS THAT CLEANS BOTH CONVEYANCE MEMBER AND PAIR OF CONVEYANCE ROLLERS, SHEET CONVEYING DEVICE

(71) Applicant: KYOCERA Document Solutions Inc., Osaka (JP)

(72) Inventor: Kaori Kitayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 83 days.

(21) Appl. No.: 16/931,856

(22) Filed: Jul. 17, 2020

(65) Prior Publication Data

US 2021/0016583 A1 Jan. 21, 2021

(30) Foreign Application Priority Data

Jul. 18, 2019 (JP) ..... JP2019-132477

(51) Int. Cl.

| | |
|---|---|
| ***B41J 29/17*** | (2006.01) |
| ***B41J 11/00*** | (2006.01) |
| ***G03G 15/00*** | (2006.01) |
| ***B41J 13/03*** | (2006.01) |
| *B41J 3/60* | (2006.01) |

(52) U.S. Cl.

CPC ..... *B41J 29/17* (2013.01); *B41J 11/007* (2013.01); *B41J 11/0095* (2013.01); *B41J 13/03* (2013.01); *G03G 15/5029* (2013.01); *G03G 15/6558* (2013.01); *B41J 3/60* (2013.01); *G03G 2221/0005* (2013.01)

(58) Field of Classification Search

CPC ..... B41J 29/17; B41J 11/007; B41J 11/0095; B41J 13/03; B41J 3/60; G03G 15/5029; G03G 15/6558; G03G 2221/0005

See application file for complete search history.

(56) References Cited

U.S. PATENT DOCUMENTS

| | | | | |
|---|---|---|---|---|
| 2016/0279970 | A1* | 9/2016 | Nakata | B41J 11/006 |
| 2017/0113476 | A1* | 4/2017 | Hara | B41J 29/17 |
| 2017/0246887 | A1 | 8/2017 | Mori | |

FOREIGN PATENT DOCUMENTS

| | | | |
|---|---|---|---|
| JP | 2017149534 | A | 8/2017 |

* cited by examiner

*Primary Examiner* — Henok D Legesse

(74) *Attorney, Agent, or Firm* — Alleman Hall Creasman & Tuttle LLP

(57) ABSTRACT

An image forming apparatus includes an image forming portion, a pair of conveyance rollers, a conveyance member, and a cleaning unit. The image forming portion forms an image on a sheet. The pair of conveyance rollers conveys the sheet at a predetermined timing to an image formation position at which the image is formed by the image forming portion. The conveyance member conveys the sheet at the image formation position. The cleaning unit includes a cleaning member that is configured to come in contact with a target roller and the conveyance member, the target roller being one of the pair of conveyance rollers that comes in contact with the sheet.

6 Claims, 5 Drawing Sheets

D1
4
43
41
3
34
33
32
31
42
35
30
30A
30
30A
30
30A

IMAGE FORMING APPARATUS THAT CLEANS BOTH CONVEYANCE MEMBER AND PAIR OF CONVEYANCE ROLLERS, SHEET CONVEYING DEVICE

INCORPORATION BY REFERENCE

This application is based upon and claims the benefit of priority from the corresponding Japanese Patent Application No. 2019-132477 filed on Jul. 18, 2019, the entire contents of which are incorporated herein by reference.

BACKGROUND

The present disclosure relates to an image forming apparatus that forms an image on a sheet, and relates to a sheet conveying device provided in the image forming apparatus.

In an image forming apparatus such as a printer, a coloring agent such as ink may be adhered to a conveyance member such as a conveyance belt that conveys a sheet at an image formation position at which an image is formed by an image forming portion. On the other hand, there is known a recording apparatus provided with a cleaning mechanism that is configured to clean the conveyance member.

SUMMARY

An image forming apparatus according to an aspect of the present disclosure includes an image forming portion, a pair of conveyance rollers, a conveyance member, and a cleaning unit. The image forming portion forms an image on a sheet. The pair of conveyance rollers conveys the sheet at a predetermined timing to an image formation position at which the image is formed by the image forming portion. The conveyance member conveys the sheet at the image formation position. The cleaning unit includes a cleaning member that is configured to come in contact with a target roller and the conveyance member, the target roller being one of the pair of conveyance rollers that comes in contact with the sheet.

A sheet conveying device according to another aspect of the present disclosure includes a pair of conveyance rollers, a conveyance member, and a cleaning unit. The pair of conveyance rollers conveys a sheet at a predetermined timing to an image formation position at which the image is formed by the image forming portion. The conveyance member conveys the sheet at the image formation position. The cleaning unit includes a cleaning member that is configured to come in contact with a target roller and the conveyance member, the target roller being one of the pair of conveyance rollers that comes in contact with the sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

Figure 1:
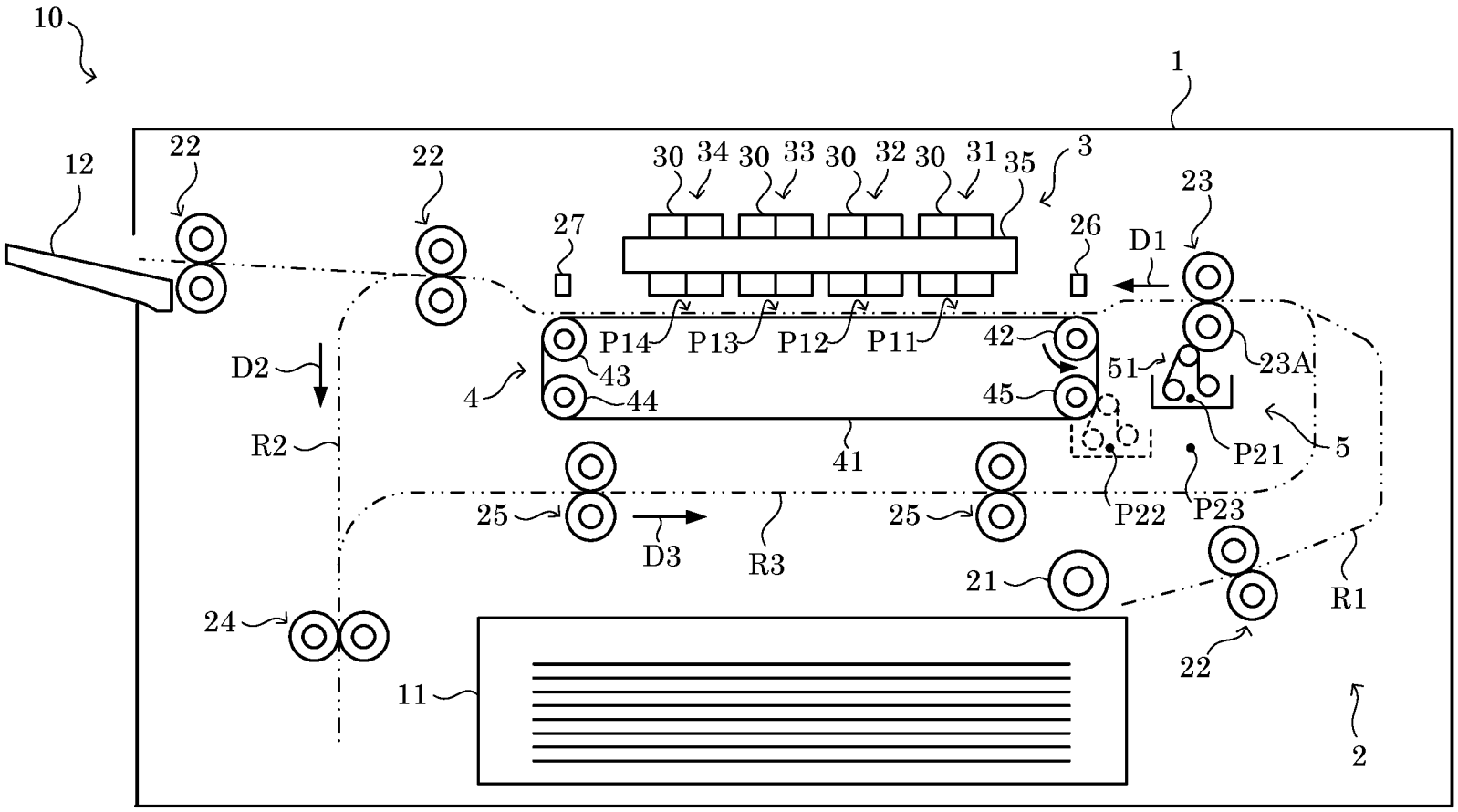
FIG. 1 is a diagram showing a configuration of an image forming apparatus according to an embodiment of the present disclosure.
Figure 2:
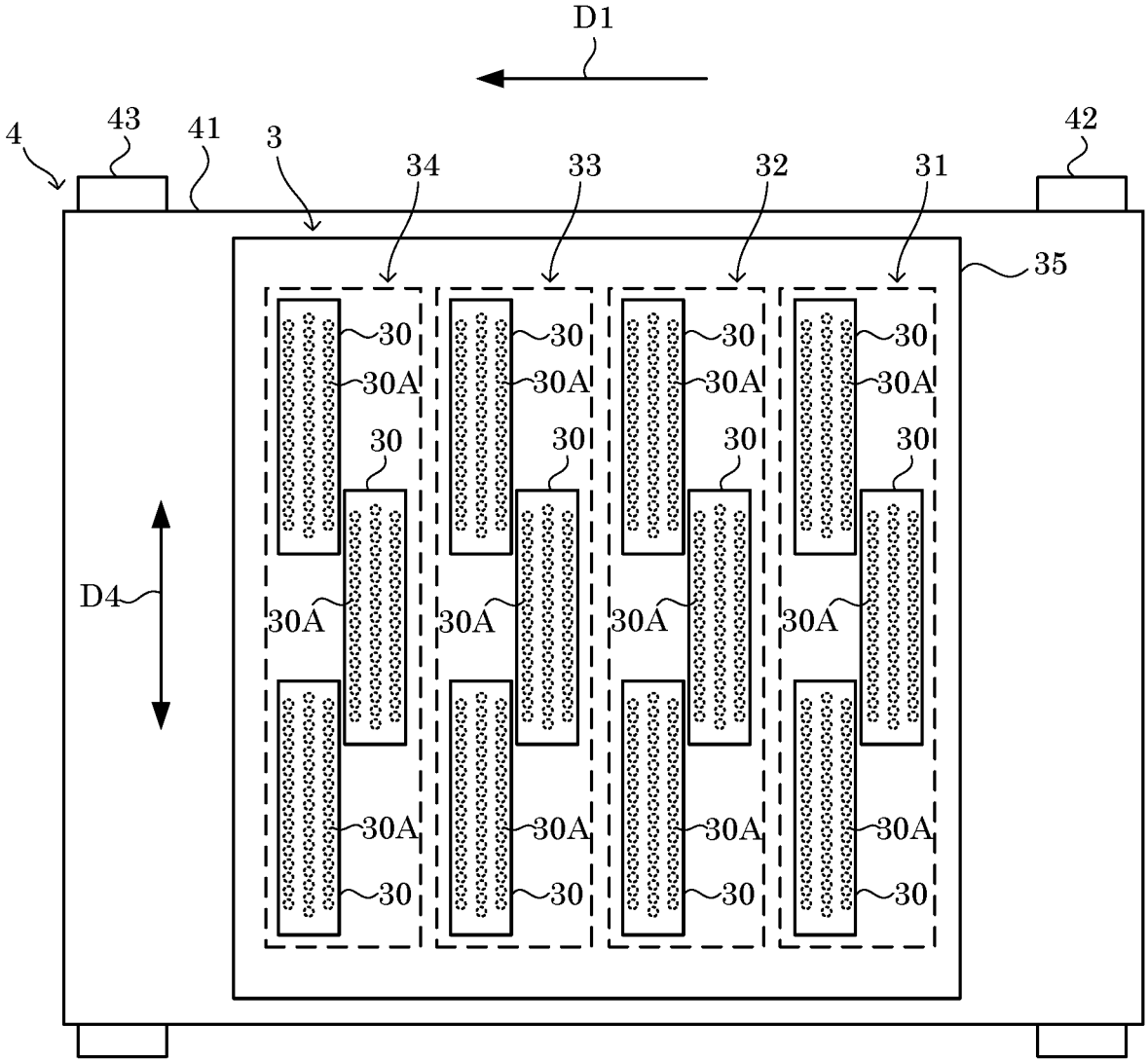
FIG. 2 is a diagram showing a configuration of an image forming portion of the image forming apparatus according to the embodiment of the present disclosure.

First, a configuration of an image forming apparatus 10 according to the embodiment of the present disclosure is described with reference to FIG. 1 to FIG. 3. Here, FIG. 1 is a cross-sectional diagram showing a configuration of the image forming apparatus 10. In addition, FIG. 2 is a plan diagram showing a configuration of an image forming portion 3. It is noted that in FIG. 1, sheet conveyance paths R1, R2, and R3 are indicated by two-dot chain lines.

The image forming apparatus 10 is a printer configured to form an image on a sheet by an inkjet method. It is noted that the present disclosure may be applied to an image forming apparatus such as a facsimile apparatus, a copier, or a multifunction peripheral that is configured to form an image by the inkjet method.

Figure 3:
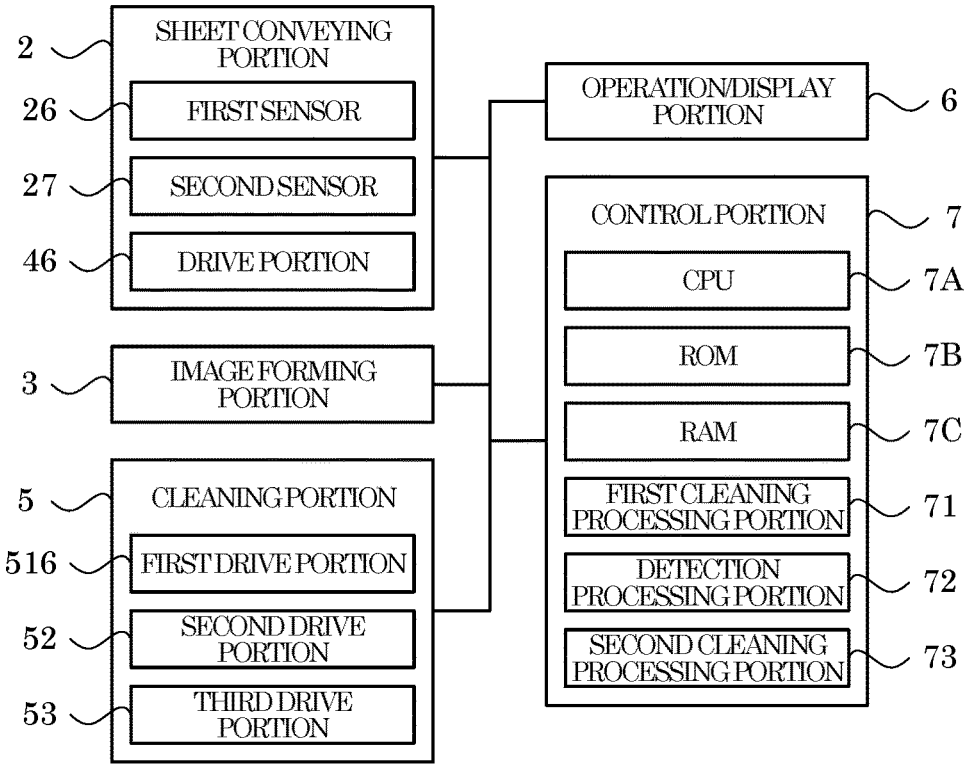
FIG. 3 is a block diagram showing a system configuration of the image forming apparatus according to the embodiment of the present disclosure.

As shown in FIG. 1 and FIG. 3, the image forming apparatus 10 includes a housing 1, a sheet conveying portion 2, the image forming portion 3, a cleaning portion 5, an operation/display portion 6, and a control portion 7. Here, a device including the housing 1, the sheet conveying portion 2 and the cleaning portion 5 is an example of a sheet conveying device of the present disclosure.

The housing 1 stores components of the image forming apparatus 10. A sheet feed cassette 11 is attached in the housing 1 in a detachable manner. Sheets on which images are to be formed are stored in the sheet feed cassette 11. For example, the sheets stored in the sheet feed cassette 11 are sheet-like materials such as sheets of paper, sheets of coated paper, postcards, envelopes, and OHP sheets. A sheet discharge tray 12 is provided at an outer side surface of the housing 1. A sheet with an image formed by the image forming portion 3 is discharged onto the sheet discharge tray 12.

The sheet conveyance paths R1, R2, and R3 for guiding a sheet conveyed by the sheet conveying portion 2 are provided in the housing 1. The sheet conveyance path R1 is a path in which the sheet moves from the sheet feed cassette 11 to the sheet discharge tray 12 via image formation positions P11 to P14 at which images are formed by the image forming portion 3. The sheet conveyance path R2 is used to reverse a sheet after an image is formed thereon by the image forming portion 3. The sheet conveyance path R3 is a path in which a sheet reversed in the sheet conveyance path R2 is re-conveyed to the image forming portion 3.

It is noted that the image formation position P11 is a position in the sheet conveyance path R1 where a line head 31 of the image forming portion 3 is disposed. In addition, the image formation position P12 is a position in the sheet conveyance path R1 where a line head 32 of the image forming portion 3 is disposed. In addition, the image formation position P13 is a position in the sheet conveyance path R1 where a line head 33 of the image forming portion 3 is disposed. In addition, the image formation position P14 is a position in the sheet conveyance path R1 where a line head 34 of the image forming portion 3 is disposed.

The sheet conveying portion 2 conveys a sheet inside the housing 1. As shown in FIG. 1, the sheet conveying portion 2 includes a pickup roller 21, pairs of first conveyance rollers 22, a pair of resist rollers 23 (an example of a pair of conveyance rollers of the present disclosure), a pair of second conveyance rollers 24, a pair of third conveyance rollers 25, a first sensor 26, a second sensor 27, and a conveyance unit 4.

The pickup roller 21 is configured to pick up sheets one by one from the sheet feed cassette 11 and feed the sheets to the sheet conveyance path R1. The pairs of first conveyance rollers 22 are provided in the sheet conveyance path R1 and configured to convey the sheets in a conveyance direction D1 (see FIG. 1). The pair of resist rollers 23 convey a sheet, at predetermined timings, to the image formation positions P11 to P14 at which images are formed by the image forming portion 3.

The pair of second conveyance rollers 24 are provided in the sheet conveyance path R2 and configured to convey a sheet in a conveyance direction D2 (see FIG. 1), and then convey the sheet in a reverse direction to the conveyance direction D2 to feed the sheet to the sheet conveyance path R3. The pair of third conveyance rollers 25 are provided in the sheet conveyance path R3 and convey the sheet in a conveyance direction D3 (see FIG. 1).

The image forming portion 3 forms an image, using ink based on image data, on a sheet supplied from the sheet feed cassette 11. As shown in FIG. 1, the image forming portion 3 includes line heads 31, 32, 33, and 34 and a head frame 35 supporting the line heads, wherein the line heads 31, 32, 33, and 34 respectively correspond to colors black, cyan, magenta, and yellow. The head frame 35 is supported by the housing 1. It is noted that the number of the line heads included in the image forming portion 3 is not limited to 4 (four).

The line heads 31 to 34 are each what is called a line-head-type recording head. That is, the image forming apparatus 10 is what is called a line-head-type image forming apparatus. As shown in FIG. 2, the line heads 31 to 34 are elongated in a width direction D4 perpendicular to the conveyance direction D1. Specifically, each of the line heads 31 to 34 has a length in the width direction D4 that corresponds to the width of a sheet of the maximum size among a plurality of sizes of sheets that can be stored in the sheet feed cassette 11. The line heads 31 to 34 are fixed to the head frame 35 at regular intervals along the conveyance direction D1.

As shown in FIG. 2, each of the line heads 31 to 34 includes a plurality of recording heads 30. The recording heads 30 eject ink toward a sheet conveyed by the conveyance unit 4. Specifically, a plurality of nozzles 30A (see FIG. 2) for ejecting ink are provided on a facing surface of each of the recording heads 30, each of the nozzles 30A having an opening, the facing surface facing a conveyance belt 41 (see FIG. 1). In addition, each of the recording heads 30 includes a plurality of pressurizing chambers (not shown), a plurality of piezoelectric elements (not shown), and a plurality of communication flow paths (not shown), the pressurizing chambers respectively corresponding to the nozzles 30A, the piezoelectric elements respectively provided in the pressurizing chambers, the communication flow paths respectively communicating with the pressurizing chambers. Upon application of a predetermined driving voltage, each of the piezoelectric elements causes ink to be ejected from a nozzle 30A that corresponds to a pressurizing chamber in which the piezoelectric element is provided. Specifically, each piezoelectric element pressurizes ink stored in the corresponding pressurizing chamber and thereby causes ink to be ejected from the corresponding nozzle 30A.

In the present embodiment, in the line head 31, three recording heads 30 are arranged in zigzag along the width direction D4. In addition, in each of the line heads 32 to 34, as in the line head 31, three recording heads 30 are arranged in zigzag along the width direction D4. Ink of colors corresponding to the line heads 31 to 34 is supplied to the line heads 31 to 34 from corresponding ink containers (not shown). It is noted that FIG. 2 shows a state of the image forming portion 3 viewed from the upper side of FIG. 1.

The conveyance unit 4 conveys a sheet at the image formation positions P11 to P14. As shown in FIG. 1, the conveyance unit 4 is disposed below the line heads 31 to 34. As shown in FIG. 1 and FIG. 3, the conveyance unit 4 includes the conveyance belt 41 (an example of a conveyance member of the present disclosure), stretching rollers 42 to 45, and a drive portion 46.

The conveyance belt 41 conveys a sheet in a posture where a surface of the sheet faces the line heads 31 to 34. The conveyance belt 41 is stretched over the stretching rollers 42 to 45. The stretching rollers 42 and 43 are provided separated from each other by a predetermined distance in a left-right direction of the housing 1 (the up-down direction in FIG. 1). The stretching roller 44 is disposed below the stretching roller 43. The stretching roller 45 is disposed below the stretching The drive portion 46 is a motor that supplies a rotational driving force to the sheet storage portion 42. The stretching roller 42 is rotationally driven by a rotational driving force supplied from the drive portion 46, to rotate in a direction indicated by an arrow in FIG. 1. This allows the conveyance belt 41 to cyclically move such that the sheet is conveyed in the conveyance direction D1 (see FIG. 1). It is noted that the conveyance unit 4 also includes an air suction unit (not shown) that sucks the air through a lot of pass-through holes formed in the conveyance belt 41 so that the sheet is attracted by the conveyance belt 41.

The first sensor 26 is configured to detect a sheet at an upstream end, in the conveyance direction D1, of a conveyance section where the sheet is conveyed by the conveyance belt 41. As shown in FIG. 1, the first sensor 26 is disposed to face the stretching roller 42 across the conveyance belt 41. In addition, the second sensor 27 is configured to detect a sheet at a downstream end, in the conveyance direction D1, of the conveyance section where the sheet is conveyed by the conveyance belt 41. As shown in FIG. 1, the second sensor 27 is disposed to face the stretching roller 43 across the conveyance belt 41. For example, the first sensor 26 and the second sensor 27 are reflection-type or transmission-type optical sensors. The first sensor 26 and the second sensor 27 are used to detect a jam (paper jam) at the conveyance section where the sheet is conveyed by the conveyance belt 41.

The operation/display portion 6 includes a display portion and an operation portion, wherein the display portion is, for example, a liquid crystal display and displays various types of information in response to control instructions from the control portion 7, and the operation portion is, for example, operation keys or a touch panel for inputting various types of information to the control portion 7 in response to user operations.

The control portion 7 includes control equipment such as a CPU 7A, a ROM 7B, and a RAM 7C. The CPU 7A is a processor that executes various calculation processes. The ROM 7B is a nonvolatile storage device in which various information such as control programs for causing the CPU 7A to execute various processes are preliminarily stored. The RAM 7C is a volatile storage device that is used as a temporary storage memory (working area) for the various processes executed by the CPU 7A. In the control portion 7, the CPU 7A executes the various control programs stored in advance in the ROM 7B. This allows the image forming apparatus 10 to be controlled comprehensively by the control portion 7. It is noted that the control portion 7 may be formed as an electronic circuit such as an integrated circuit (ASIC), and may be a control portion provided independently of a main control portion that comprehensively controls the image forming apparatus 10.

Meanwhile, in the image forming apparatus 10, ink may be adhered to the conveyance belt 41. In this regard, there is known a recording apparatus that includes a cleaning mechanism configured to clean the conveyance belt 41.

In addition, in the image forming apparatus 10, ink may be adhered to the pair of resist rollers 23. In this regard, a cleaning mechanism for cleaning the pair of resist rollers 23 may be provided independent of the cleaning mechanism for cleaning the conveyance belt 41. However, this causes an increase in the number of components of the image forming apparatus 10.

On the other hand, as described below, the image forming apparatus 10 according to the embodiment of the present disclosure is configured to clean both the conveyance belt 41 and the pair of resist rollers 23 without including additional components.

Figure 4:
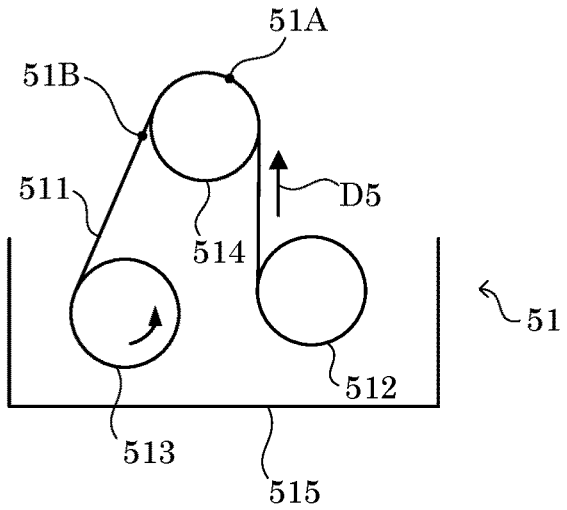
FIG. 4 is a diagram showing a configuration of a cleaning unit of the image forming apparatus according to the embodiment of the present disclosure.

In the following, the cleaning portion 5 and the control portion 7 are described in detail with reference to FIG. 1, FIG. 3, and FIG. 4. It is noted that FIG. 4 is a cross-sectional diagram showing a configuration of a cleaning unit 51.

The cleaning portion 5 cleans both a target roller 23A (see FIG. 1) and the conveyance belt 41, wherein the target roller 23A is one of the pair of resist rollers 23 and comes in contact with a back surface of a sheet that is opposite from a surface on which an image is formed by the image forming portion 3. As shown in FIG. 1 and FIG. 3, the cleaning portion 5 includes the cleaning unit 51, a second drive portion 52, and a third drive portion 53.

The cleaning unit 51 is configured to clean both the target roller 23A and the conveyance belt 41. Specifically, the cleaning unit 51 is provided in such a way as to be movable between a first position P21 and a second position P22 via a home position P23 shown in FIG. 1, wherein at the first position P21, a cleaning member 511 (see FIG. 4) of the cleaning unit 51 comes in contact with the target roller 23A, and at the second position P22, the cleaning member 511 comes in contact with the conveyance belt 41.

For example, the housing 1 includes a unit support portion that supports the cleaning unit 51. The unit support portion supports the cleaning unit 51 such that the cleaning unit 51 can move in a left-right direction (an up-down direction in FIG. 1) of the housing 1. In addition, the unit support portion is supported by the housing 1 such that the unit support portion can move in an up-down direction (a left-right direction in FIG. 1) of the housing 1. As the unit support portion moves in the up-down direction, the cleaning unit 51 moves between the home position P23 and the first position P21. In addition, as the unit support portion moves in the left-right direction in a lifted-down state, the cleaning unit 51 moves between the home position P23 and the second position P22.

As shown in FIG. 4, the cleaning unit 51 includes the cleaning member 511, a supply roller 512, a winding roller 513, a stretching roller 514, a support portion 515, and a first drive portion 516.

The cleaning member 511 is configured to come in contact with both cleaning targets, the target roller 23A and the conveyance belt 41. The cleaning member 511 comes in contact with each cleaning target and wipes off the adhered ink from each cleaning target. For example, the cleaning member 511 is a piece of a woven or non-woven fabric formed in the shape of a belt. The supply roller 512 supplies the cleaning member 511. The supply roller 512 is a roller around which the cleaning member 511 is wound. The cleaning member 511, having been wound around the supply roller 512, is pulled out from the supply roller 512, stretched over the stretching roller 514, and fixed to the winding roller 513. The support portion 515 rotatably supports the supply roller 512, the winding roller 513, and the stretching roller 514, and supports the first drive portion 516. The first drive portion 516 supplies a rotational driving force to the winding roller 513. For example, the first drive portion 516 is a solenoid or a motor. The winding roller 513 winds up around itself the cleaning member 511 supplied from the supply roller 512. The winding roller 513 is rotationally driven in a direction indicated by the arrow in FIG. 4, by the rotational driving force supplied from the first drive portion 516. This allows the cleaning member 511 stretched between the supply roller 512 and the winding roller 513 to move in a winding direction D5 shown in FIG. 4.

The second drive portion 52 supplies a driving force to the cleaning unit 51 such that the cleaning unit 51 moves in the left-right direction (the up-down direction in FIG. 1) of the housing 1. For example, the second drive portion 52 is a motor. The cleaning unit 51 moves between the home position P23 and the second position P22 by the driving force supplied from the second drive portion 52. In the image forming apparatus 10, in a state where the cleaning unit 51 is located at the second position P22, the conveyance belt 41 comes in contact with a second contact portion 51B of the cleaning unit 51. As shown in FIG. 4, the second contact portion 51B is a portion of the cleaning unit 51 at which the cleaning member 511 stretched between the stretching roller 514 and the winding roller 513 is present.

The third drive portion 53 supplies a driving force that causes the unit support portion supporting the cleaning unit 51 to move in the up-down direction (the left-right direction in FIG. 1) of the housing 1. For example, the third drive portion 53 is a motor. As the unit support portion moves in the up-down direction by the driving force supplied from the third drive portion 53, the cleaning unit 51 moves between the home position P23 and the first position P21. In the image forming apparatus 10, in a state where the cleaning unit 51 is located at the first position P21, the target roller 23A comes in contact with a first contact portion 51A of the cleaning unit 51. As shown in FIG. 4, the first contact portion 51A is a portion of the cleaning unit 51 at which the cleaning member 511 wound around the stretching roller 514 is present. The first contact portion 51A is located upstream of the second contact portion 51B in the winding direction D5 in a winding path of the cleaning member 511.

As shown in FIG. 3, the control portion 7 includes a first cleaning processing portion 71, a detection processing portion 72, and a second cleaning processing portion 73. For example, a cleaning control program for causing the CPU 7A of the control portion 7 to execute a cleaning control process (see the flowchart of FIG. 5) described below is preliminarily stored in the ROM 7B. It is noted that the cleaning control program may be recorded on a computer-readable recording medium such as a CD, a DVD, or a flash memory, and may be installed from the recording medium to a nonvolatile storage device provided in the image forming apparatus 10.

The control portion 7 executes the cleaning control program stored in the ROM 7B by using the CPU 7A. This allows the control portion 7 to function as the first cleaning processing portion 71, the detection processing portion 72, and the second cleaning processing portion 73.

The first cleaning processing portion 71, when a duplex print process is executed, executes a first cleaning process to clean the target roller 23A by using the cleaning unit 51, wherein in the duplex print process, images are printed on opposite surfaces of a sheet in the image forming apparatus 10.

For example, the first cleaning processing portion 71 executes the first cleaning process from the start to the end of the duplex print process.

Specifically, in the first cleaning process, at the start of the duplex print process, the cleaning unit 51 moves from the home position P23 to the first position P21. This allows the cleaning member 511 of the cleaning unit 51 to come in contact with the target roller 23A. This makes it possible for the cleaning member 511 to wipe off the ink from the surface of the target roller 23A when an image is printed on a back surface of a sheet.

In addition, in the first cleaning process, when the duplex print process ends, the cleaning unit 51 moves from the first position P21 to the home position P23, and the winding roller 513 is rotationally driven such that the cleaning member 511 is wound up by a predetermined first reference distance. The first reference distance is determined such that when the cleaning member 511 is wound up by the first reference distance, a dirt adhered at the first contact portion 51A moves to a downstream of the first contact portion 51A in the winding direction D5. With this configuration, when the first cleaning process is executed next time, a part of the cleaning unit 51 on which no dirt is adhered is used to clean the target roller 23A.

It is noted that the first cleaning processing portion 71 may execute the first cleaning process only when the target roller 23A is in contact with a sheet with an image formed on a surface thereof. In addition, the first cleaning processing portion 71 may execute the first cleaning process when a simplex print process is executed in which an image is printed on one of two opposite surfaces of a sheet in the image forming apparatus 10.

The detection processing portion 72, by using the first sensor 26 and the second sensor 27, detects a paper jam (a jam) at the conveyance section where the sheet is conveyed by the conveyance belt 41.

Specifically, the detection processing portion 72 detects an occurrence of a paper jam when the first sensor 26 does not detect a rear end of a print-target sheet during a predetermined first time period after the first sensor 26 detects a front end of the print-target sheet and. Here, the first time period is determined based on a result of dividing a length of the print-target sheet in the conveyance direction D1 by a speed at which the pair of resist rollers 23 and the conveyance belt 41 convey the sheet.

In addition, the detection processing portion 72 detects an occurrence of a paper jam when the second sensor 27 does not detect a front end of a print-target sheet during a predetermined second time period after the first sensor 26 detects the front end of the print-target sheet. Here, the second time period is determined based on a result of dividing a distance of a conveyance section where the sheet is conveyed by the conveyance belt 41, namely, a distance between a disposal position of the first sensor 26 and a disposal position of the second sensor 27, by the speed at which the pair of resist rollers 23 and the conveyance belt 41 convey the sheet.

The second cleaning processing portion 73, in a case where an occurrence of a paper jam has been detected by the detection processing portion 72, executes a second cleaning process to clean the conveyance belt 41 by using the cleaning unit 51.

For example, the second cleaning processing portion 73 executes the second cleaning process after a paper jam is solved and before a print process suspended by a detection of the paper jam is resumed.

Specifically, in the second cleaning process, first, the winding roller 513 is rotationally driven, and the cleaning member 511 is wound up by a predetermined second reference distance. The second reference distance is set so that when the cleaning member 511 is wound up by the second reference distance, a dirt adhered at the first contact portion 51A moves to a downstream of the second contact portion 51B in the winding direction D5. With this configuration, it is possible to clean the conveyance belt 41 by using a part of the cleaning member 511 on which no dirt is adhered.

Next, a cleaning-target area of the conveyance belt 41 is determined based on an elapsed time between a time when the first sensor 26 detected a front end of a print-target sheet and a time when the detection processing portion 72 detected an occurrence of a paper jam. For example, the cleaning-target area extends from a portion of the conveyance belt 41 that has come in contact with the front end of the print-target sheet toward the upstream in the rotation direction of the conveyance belt 41 by a distance corresponding to a result of multiplying the conveyance speed of the conveyance belt 41 and the elapsed time.

Subsequently, the conveyance belt 41 is rotationally driven so that a downstream end of the cleaning-target area in the rotation direction of the conveyance belt 41 is disposed at a position that comes in contact with the cleaning unit 51. Subsequently, the cleaning unit 51 moves from the home position P23 to the second position P22. This allows the cleaning member 511 of the cleaning unit 51 to come in contact with the conveyance belt 41.

Subsequently, the conveyance belt 41 is rotationally driven until an upstream end of the cleaning-target area in the rotation direction of the conveyance belt 41 is disposed at a position that comes in contact with the cleaning unit 51. This allows ink that has been adhered to the cleaning-target area by the occurrence of the paper jam, to be wiped off by the cleaning member 511.

Thereafter, the cleaning unit 51 moves from the first position P21 to the home position P23. In the second cleaning process, the above-described processing procedure is repeated a predetermined number of times so that the cleaning-target area is cleaned one or more times. For example, the predetermined number of times is determined based on an amount of ink ejected by the image forming portion 3 during the elapsed time. It is noted that after an initial cleaning of the cleaning-target area, the cleaning member 511 may be wound up by the first reference distance.

It is noted that the second cleaning processing portion 73 may execute the second cleaning process when a predetermined execution timing comes, the execution timing being different from a time when an occurrence of a paper jam is detected. For example, the execution timing is when the image forming apparatus 10 has been powered on, when the mode has returned to a normal mode from a sleep mode, when the number of prints output from the image forming apparatus 10 has reached an integral multiple of a predetermined reference number, or when a predetermined operation has been performed on the operation/display portion 6.

[Operation Control Process]

Figure 5:
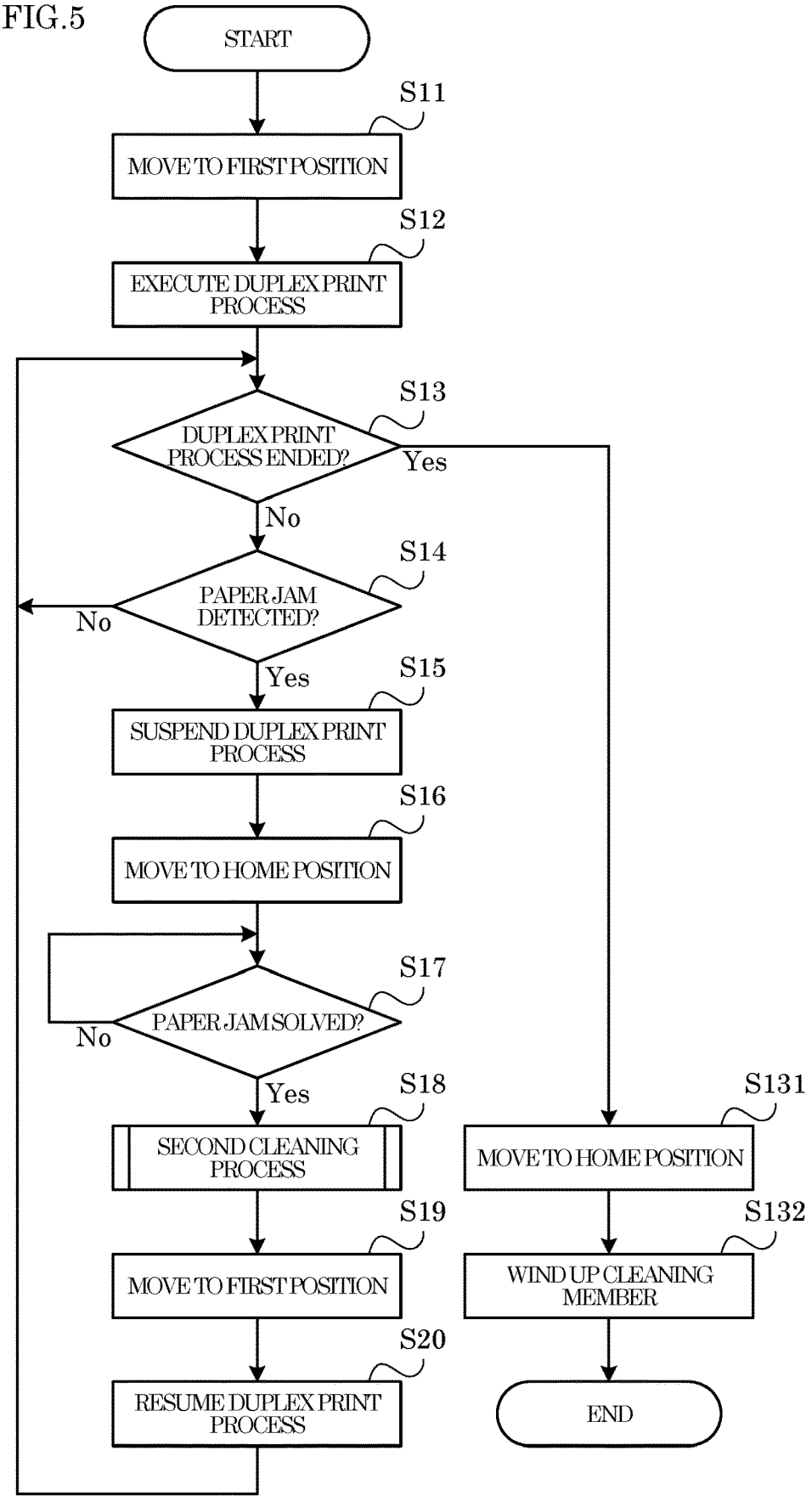
FIG. 5 is a flowchart showing an example of a cleaning control process executed in the image forming apparatus according to the embodiment of the present disclosure.

In the following, with reference to FIG. 5, a description is given of an example of the procedure of the cleaning control process executed by the control portion 7 in the image forming apparatus 10. Here, steps S11, S12, . . . represent numbers assigned to the processing procedures (steps) executed by the control portion 7. It is noted that the cleaning control process is executed in response to a user operation performed on the operation/display portion 6, or executed when an instruction to execute the duplex print process has been input from an external information processing apparatus.

<Step S11>

First, in step S11, the control portion 7 moves the cleaning unit 51 from the home position P23 to the first position P21.

<Step S12>

In step S12, the control portion 7 starts to execute the duplex print process in accordance with the execution instruction that has been input.

<Step S13>

In step S13, the control portion 7 determines whether or not the duplex print process started in step S12 has ended.

Here, upon determining that the duplex print process has ended (Yes side at S13), the control portion 7 moves the process to step S131. In addition, upon determining that the duplex print process has not ended (No side at S13), the control portion 7 moves the process to step S14.

<Step S14>

In step S14, the control portion 7 determines whether or not an occurrence of a paper jam has been detected. Here, the process of detecting the occurrence of the paper jam is executed by the detection processing portion 72 of the control portion 7.

Here, upon determining that an occurrence of a paper jam has been detected (Yes side at S14), the control portion 7 moves the process to step S15. In addition, upon determining that an occurrence of a paper jam has not been detected (No side at S14), the control portion 7 moves the process to step S13, and waits for the duplex print process to end or for a paper jam to occur.

<Step S131>

In step S131, the control portion 7 moves the cleaning unit 51 from the first position P21 to the home position P23.

<Step S132>

In step S132, the control portion 7 rotationally drives the winding roller 513 to wind up the cleaning member 511 by the first reference distance. Thereafter, the control portion 7 ends the cleaning control process. Here, a sequence of processes including steps S11, S131, and S132 is an example of the first cleaning process and is executed by the first cleaning processing portion 71 of the control portion 7. It is noted that the process of step S132 may be executed before step S11.

<Step S15>

In step S15, the control portion 7 suspends the duplex print process. The control portion 7 then notifies the user that an occurrence of a paper jam has been detected. For example, the control portion 7 displays on the operation/display portion 6 an alarm screen including a message that an occurrence of a paper jam has been detected.

<Step S16>

In step S16, the control portion 7 moves the cleaning unit 51 from the first position P21 to the home position P23.

<Step S17>

In step S17, the control portion 7 determines whether or not the paper jam has been solved. For example, when a predetermined operation has been performed on the operation/display portion 6, the control portion 7 determines that the paper jam has been solved.

Here, upon determining that the paper jam has been solved (Yes side at S17), the control portion 7 moves the process to step S18. In addition, upon determining that the paper jam has not been solved (No side at S17), the control portion 7 waits at step S17 for the paper jam to be solved.

<Step S18>

In step S18, the control portion 7 executes the second cleaning process. Here, the process of step S18 is executed by the second cleaning processing portion 73 of the control portion 7.

<Step S19>

In step S19, the control portion 7 moves the cleaning unit 51 from the home position P23 to the first position P21.

<Step S20>

In step S20, the control portion 7 resumes the duplex print process.

[Second Cleaning Process]

Figure 6:
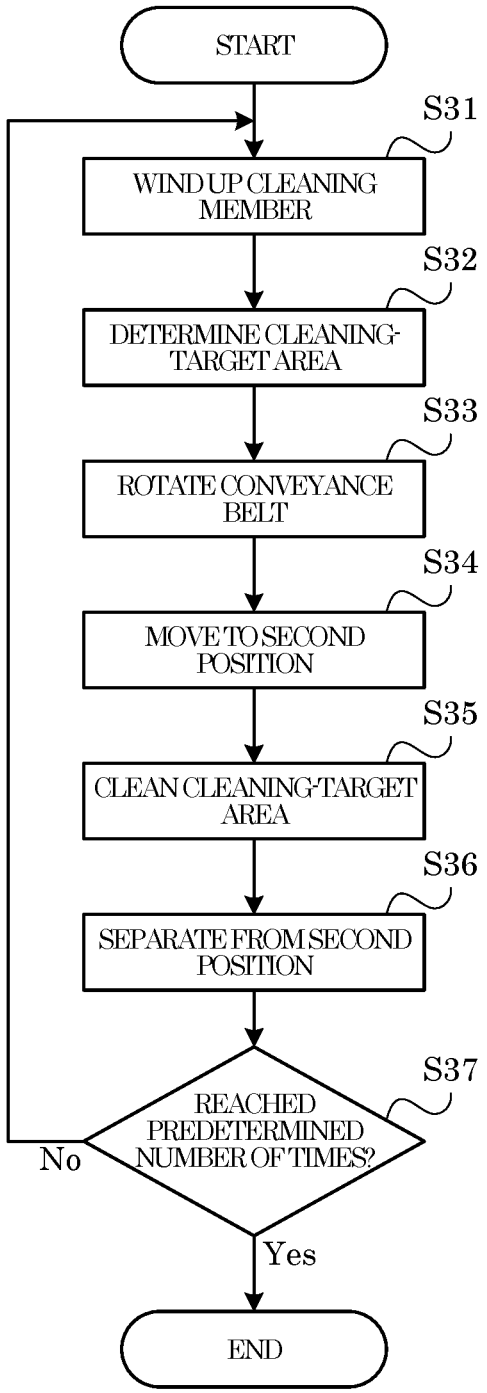
FIG. 6 is a flowchart showing an example of a second cleaning process executed in the image forming apparatus according to the embodiment of the present disclosure.

Next, with reference to FIG. 6, a description is given of an example of the procedure of the second cleaning process executed in step S18 of the cleaning control process.

<Step S31>

First, in step S31, the control portion 7 rotationally drives the winding roller 513 to wind up the cleaning member 511 by the second reference distance.

<Step S32>

In step S32, the control portion 7 determines the cleaning-target area of the conveyance belt 41 based on an elapsed time between a time when the first sensor 26 detected a front end of a print-target sheet and a time when the occurrence of the paper jam was detected in step S14.

<Step S33>

In step S33, the control portion 7 rotationally drives the conveyance belt 41 so that a downstream end of the cleaning-target area in the rotation direction of the conveyance belt 41 is disposed at a position that comes in contact with the cleaning unit 51. For example, the control portion 7 rotationally drives the conveyance belt 41 to move in the conveyance direction D1.

<Step S34>

In step S34, the control portion 7 moves the cleaning unit 51 from the home position P23 to the second position P22.

<Step S35>

In step S35, the control portion 7 rotationally drives the conveyance belt 41 until an upstream end of the cleaning-target area in the rotation direction of the conveyance belt 41 is disposed at a position that comes in contact with the cleaning unit 51.

<Step S36>

In step S36, the control portion 7 separates the cleaning unit 51 from the second position P22. For example, in a case where the number of cleanings of the cleaning-target area has not reached the predetermined number of times, namely, in a case where the cleaning of the cleaning-target area has not been completed, the control portion 7 moves the cleaning unit 51 from the second position P22 toward the home position P23 by a distance that is equal to a distance by which the cleaning unit 51 can be separated from the conveyance belt 41. In addition, in a case where the number of cleanings of the cleaning-target area has reached the predetermined number of times, namely, in a case where the cleaning of the cleaning-target area has been completed, the control portion 7 moves the cleaning unit 51 from the second position P22 to the home position P23.

<Step S37>

In step S37, the control portion 7 determines whether or not the number of cleanings of the cleaning-target area has reached the predetermined number of times.

Here, upon determining that the number of cleanings of the cleaning-target area has reached the predetermined number of times (Yes side at S37), the control portion 7 ends the second cleaning process. In addition, upon determining that the number of cleanings of the cleaning-target area has not reached the predetermined number of times (No side at S37), the control portion 7 moves the process to step S31. It is noted that after the initial cleaning of the cleaning-target area is completed, in step S31, the cleaning member 511 may be wound up by the first reference distance. In addition, after the initial cleaning of the cleaning-target area is completed, the process of step S32 may be omitted. In addition, after the initial cleaning of the cleaning-target area is completed, in step S33, the conveyance belt 41 may be rotationally driven to move in a direction reverse to the conveyance direction D1.

It is noted that processes of steps S32 and S33 may be omitted. That is, a cleaning may be performed on a front surface of the sheet conveyance surface of the conveyance belt 41. In this case, after an execution of the process of step S34, the control portion 7 may drive the conveyance belt 41 to rotate as many times as the predetermined number of times, then execute the process of step S36 and end the second cleaning process.

As described above, the image forming apparatus 10 is provided with the cleaning unit 51 that is configured to clean both the target roller 23A and the conveyance belt 41, wherein the target roller 23A is one of the pair of resist rollers 23 that comes in contact with a back surface of a sheet. With this configuration, it is possible to clean both the conveyance belt 41 and the pair of resist rollers 23 without including additional components.

[Modifications]

It is noted that the cleaning member 511 may be, for example, sponge or a rubber blade. In this case, the cleaning unit 51 may include, in place of the supply roller 512, the winding roller 513, the stretching roller 514, and the first drive portion 516, a support member that supports the cleaning member 511. In addition, the cleaning member 511 may be configured to come in contact with one of the pair of resist rollers 23 that comes in contact with a front surface of a sheet. For example, the cleaning member 511 may be formed from sponge and configured to come in contact with both the two rollers of the pair of resist rollers 23.

In addition, in the cleaning portion 5, the cleaning unit 51 may not be configured to move. For example, the cleaning unit 51 may include: the cleaning member 511 that is configured to come in contact with both the target roller 23A and the conveyance belt 41; and a support portion that supports the cleaning member 511.

In addition, the present disclosure may be applied to an electrophotographic image forming apparatus. That is, the present disclosure is applicable to an electrophotographic image forming apparatus that includes the pair of resist rollers 23 and the conveyance belt 41. In addition, in this case, the cleaning member 511 may be a roller-like or brush-like member configured to electrostatically attract the toner that has adhered to a cleaning target.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image forming portion configured to form an image on a sheet;

a pair of conveyance rollers configured to convey the sheet at a predetermined timing to an image formation position at which the image is formed by the image forming portion;

a conveyance member configured to convey the sheet at the image formation position;

a cleaning unit including a cleaning member configured to come in contact with a target roller and the conveyance member, the target roller being one of the pair of conveyance rollers that comes in contact with the sheet, the cleaning unit configured to move between a first position and a second position, wherein at the first position, the cleaning member comes in contact with the target roller, and at the second position, the cleaning member comes in contact with the conveyance member;

a first sensor configured to detect the sheet at an upstream end of a conveyance section in a conveyance direction in which the sheet is conveyed by the conveyance member;

a second sensor configured to detect the sheet at a downstream end of the conveyance section in the conveyance direction;

a detection processing portion configured to detect an occurrence of a paper jam by using the first sensor and the second sensor; and a first cleaning processing portion configured to, in a case where the detection processing portion has detected the occurrence of the paper jam, execute a second cleaning process to clean the conveyance member by using the cleaning unit, wherein in the second cleaning process, a cleaning-target area of the conveyance member is determined based on an elapsed time between a time when the first sensor detected the sheet and a time when the detection processing portion detected the occurrence of the paper jam, a cleaning by the cleaning unit is performed on the determined cleaning-target area, and the cleaning by the cleaning unit is not performed outside the cleaning-target area of the conveyance member.

2. The image forming apparatus according to claim 1, wherein the target roller is one of the pair of conveyance rollers that comes in contact with a back surface of the sheet.

3. The image forming apparatus according to claim 1, further comprising:

a second cleaning processing portion configured to, when a duplex print process is executed, execute a first cleaning process to clean the target roller by using the cleaning unit, wherein in the duplex print process, images are printed on opposite surfaces of the sheet.

4. The image forming apparatus according to claim 1, wherein the image forming portion forms the image by using ink, and the cleaning member comes in contact with a cleaning target and wipes off from the cleaning target the ink that has adhered thereto.

5. The image forming apparatus according to claim 4, wherein the cleaning member is a piece of a woven or non-woven fabric formed in a shape of a belt, and the cleaning unit includes a supply roller and a winding roller, the supply roller supplying the cleaning member, the winding roller winding up around itself the cleaning member supplied from the supply roller.

6. A sheet conveying device comprising:

a pair of conveyance rollers configured to convey a sheet at a predetermined timing to an image formation position at which an image is formed by an image forming portion;

a conveyance member configured to convey the sheet at the image formation position;

a cleaning unit including a cleaning member configured to come in contact with a target roller and the conveyance member, the target roller being one of the pair of conveyance rollers that comes in contact with the sheet, the cleaning unit configured to move between a first position and a second position, wherein at the first position, the cleaning member comes in contact with the target roller, and at the second position, the cleaning member comes in contact with the conveyance member;

a first sensor configured to detect the sheet at an upstream end of a conveyance section in a conveyance direction in which the sheet is conveyed by the conveyance member;

a second sensor configured to detect the sheet at a downstream end of the conveyance section in the conveyance direction;

a detection processing portion configured to detect an occurrence of a paper jam by using the first sensor and the second sensor; and a first cleaning processing portion configured to, in a case where the detection processing portion has detected the occurrence of the paper jam, execute a second cleaning process to clean the conveyance member by using the cleaning unit, wherein in the second cleaning process, a cleaning-target area of the conveyance member is determined based on an elapsed time between a time when the first sensor detected the sheet and a time when the detection processing portion detected the occurrence of the paper jam, a cleaning by the cleaning unit is performed on the determined cleaning-target area, and the cleaning by the cleaning unit is not performed outside the cleaning-target area of the conveyance member.

* * * * *